US008741429B2

(12) United States Patent
Kanba et al.

(10) Patent No.: US 8,741,429 B2
(45) Date of Patent: Jun. 3, 2014

(54) FIXING HEATER AND MANUFACTURING METHOD THEREOF

(75) Inventors: Noboru Kanba, Fujioka (JP); Yoshihisa Suda, Fujioka (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 65 days.

(21) Appl. No.: 13/359,221

(22) Filed: Jan. 26, 2012

(65) Prior Publication Data

US 2012/0118872 A1 May 17, 2012

Related U.S. Application Data

(62) Division of application No. 11/629,698, filed as application No. PCT/JP2005/011389 on Jun. 15, 2005, now abandoned.

(30) Foreign Application Priority Data

Jun. 16, 2004 (JP) ..... 2004-178420

(51) Int. Cl.
*H01B 1/24* (2006.01)

(52) U.S. Cl.
USPC ..... 428/368; 428/372; 252/502; 338/225

(58) Field of Classification Search
USPC ..... 252/502; 428/368, 372; 338/225
See application file for complete search history.

(56) References Cited

U.S. PATENT DOCUMENTS

| | | | | |
|---|---|---|---|---|
| 3,235,323 | A * | 2/1966 | Peters | 8/189 |
| 4,916,292 | A * | 4/1990 | Kawakubo et al. | 219/553 |
| 5,106,540 | A * | 4/1992 | Barma et al. | 252/511 |
| 5,881,208 | A | 3/1999 | Geyling et al. | |
| 6,501,056 | B1 | 12/2002 | Hirohata et al. | |
| 6,627,116 | B1 | 9/2003 | Suda et al. | |
| 2002/0028360 | A1 * | 3/2002 | Shaffer et al. | 428/699 |
| 2002/0096984 | A1 | 7/2002 | Konishi et al. | |
| 2004/0040952 | A1 | 3/2004 | Suda et al. | |
| 2006/0157464 | A1 | 7/2006 | Omata et al. | |

FOREIGN PATENT DOCUMENTS

| | | |
|---|---|---|
| EP | 8 328 405 A | 12/1996 |
| JP | 04-147595 A | 5/1992 |
| JP | 04-185455 | 7/1992 |
| JP | 05-011654 | 1/1993 |
| JP | 06-019347 | 1/1994 |
| JP | 06-175525 | 6/1994 |
| JP | 07-160132 | 6/1995 |
| JP | 08-328405 | 12/1996 |
| JP | 10-091027 | 4/1998 |
| JP | 11-162618 | 6/1999 |
| JP | 2001-015250 | 1/2001 |
| JP | 2002-214951 | 1/2001 |
| JP | 2003-21596507 | 7/2003 |
| JP | 2006-154802 | 6/2006 |
| WO | WO-01/41507 A1 | 6/2001 |

* cited by examiner

*Primary Examiner* — Tri V Nguyen
(74) *Attorney, Agent, or Firm* — Foley & Lardner LLP

(57) ABSTRACT

A fixing heater is provided that employs, as a heating element, a material having small heat capacity and excellent wear resistance. A metal or semi-metal compound that can act as an electrical conduction inhibiting material is mixed into a carbon-containing resin such as a furan resin, chlorinated vinyl chloride resin, etc., and a pattern of a heating element is formed on a substrate, by screen printing, and then is sintered at temperature of about 1000° C. to obtain a fixing heater including amorphous carbon and having NTC characteristics.

2 Claims, 3 Drawing Sheets

FIXING HEATER AND MANUFACTURING METHOD THEREOF

CROSS-REFERENCE TO RELATED PATENT APPLICATIONS

This application is a divisional of application Ser. No. 11/629,698, filed Dec. 15, 2006, now pending, which is the National Stage of Application No. PCT/JP2005/011389 filed on Jun. 15, 2005, which is based upon and claims the benefit of priority from Japanese Patent Application No. 2004-178420, filed Jun. 16, 2004, the entire contents of all of which are incorporated herein by reference. This application claims only subject matter disclosed in the parent application and therefore presents no new matter.

FIELD OF THE INVENTION

The present invention relates to a fixing heater, in an image forming apparatus of an electro-photography type, and to a manufacturing method thereof.

BACKGROUND ART

Japanese Patent Publication No. 04-147595 discloses a fixing heater, for a copying machine, comprising an electrically conductive powder such as a powder of silver, silver/palladium, carbon powder, etc., bound with a synthetic resin to form a heating element on a substrate. The surface of the heating element is covered by a glassy protecting film to help the object to be heated to slip and to prevent wear of the heating element.

Japanese patent Publication No. 07-160132 discloses a heating device, in a film heating system, comprising a heating element formed by sintering a compound of transition metal elements such as Mn, Ni, Fe, etc., so as to exhibit a negative temperature coefficient (NTC) in order to use the NTC characteristics to control the temperature of the heating element itself.

DISCLOSURE OF THE INVENTION

It is an object of the present invention to provide a novel fixing heater in which a heating element layer consisting of a material having excellent characteristics as a heating element for a fixing device of an image forming apparatus of an electro-photography type is formed on a substrate.

In accordance with the present invention, there is provided a fixing heater comprising a substrate and a carboneous heating element layer which is provided on the substrate and which includes amorphous carbon and a metal or semi-metal compound uniformly dispersed in the amorphous carbon as an electrical conduction inhibiting material.

The above-mentioned carboneous heating element layer may further include a carbon powder uniformly dispersed in said amorphous carbon.

The fixing heater according to the present invention can be manufactured by a method comprising the steps of uniformly mixing, into a carbon-containing resin, a metal or semi-metal compound which can serve as an electrical conduction inhibiting material after carbonization of the carbon-containing resin, providing a layer of the mixture on a substrate, and sintering the mixture provided on the substrate in an inactive atmosphere, preferably under vacuum, to carbonize said carbon-containing resin. In this case, a heating element having a desired intrinsic resistance value can be obtained by suitably adjusting the blending ratio of the carbon-containing resin and the metal or semi-metal compound to thereby adjust the ratio of the carbon as a good electrical conductor to the metal or semi-metal compound, as an electrical conduction inhibiting material, in the heating element after sintering.

In case where, for example, the heating element is formed into a thin film by using technique such as screen printing and has small cross sectional area, a low intrinsic resistivity may be required in order to obtain a desired resistance value. In such a case, the metal or semi-metal compound may be omitted and a heating element having a desired intrinsic resistance value can be obtained by adjusting the blending ratio of the carbon-containing resin and the carbon powder to thereby adjust the ratio of amorphous carbon and carbon powder in the heating element after sintering. In this case, the amorphous carbon acts as an electrical conduction inhibiting material relative to the carbon powder.

As the fixing heater according to the present invention has carbon as the main component of the heating element, it has small heat capacity and, therefore, takes little time to heat up and cool down. Thus, it has excellent characteristics as a fixing heater in that the warm-up time of the device can be reduced. In addition, since it has amorphous carbon as main component, it has high wear resistance, and eliminates the need of a protecting film that is required for an Ag/Pd based system.

As disclosed in Japanese Patent Publication No. 2001-15250, the composite carbon material comprising amorphous carbon obtained by sintering of a carbon-containing resin and a metal or semi-metal compound as an electrical conduction inhibiting material uniformly dispersed in the amorphous carbon permits the temperature characteristics to be varied from NTC to PTC (Positive Temperature Coefficient) by changing the conditions such as sintering temperature, etc. Thus, for example, by selecting the sintering temperature for carbonization lower than 1700° C., a fixing heater having a NTC characteristics can be obtained.

In order to provide a layer of said mixture on said substrate, the technique of screen printing, for example, may be adopted. In place of sintering after provision of the mixture layer on the substrate, a plate of the mixture formed in a thin plate shape may be sintered, and then, applied to the substrate using adhesive material or the like.

BEST MODE FOR CARRYING OUT THE INVENTION

Figure 1:
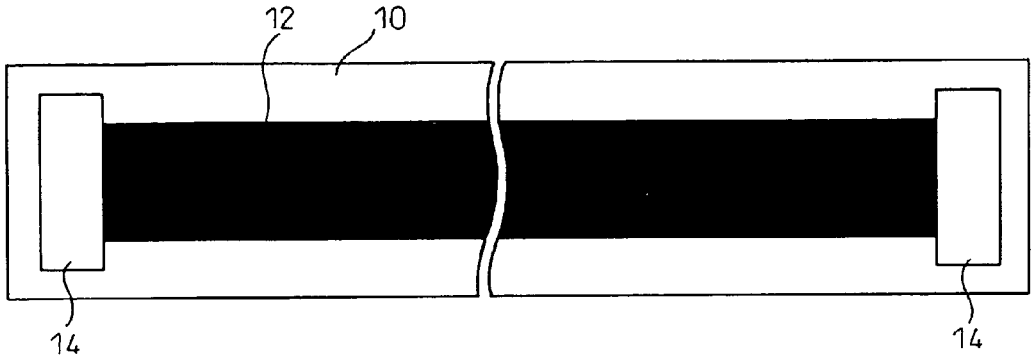
FIG. 1 is a view showing a first example of the pattern of heating element layer.
Figure 2:
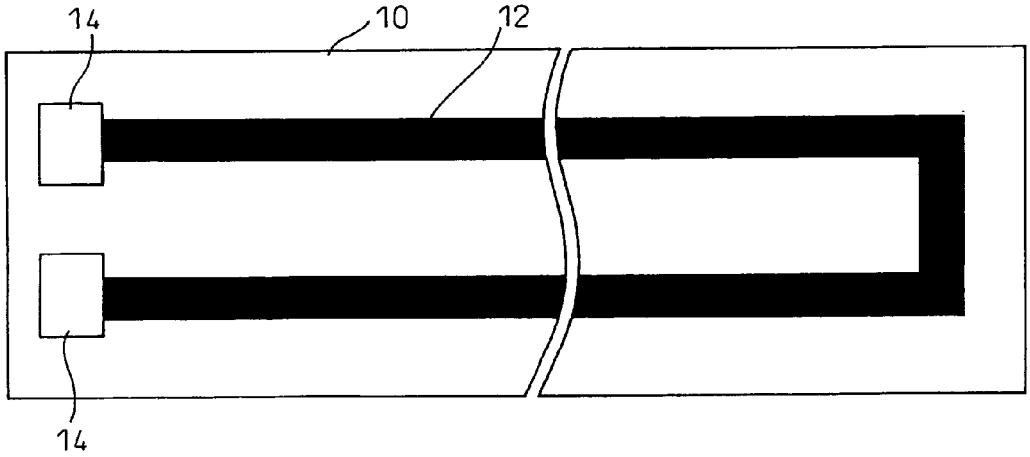
FIG. 2 is a view showing a second example of the pattern of heating element layer.
Figure 3:
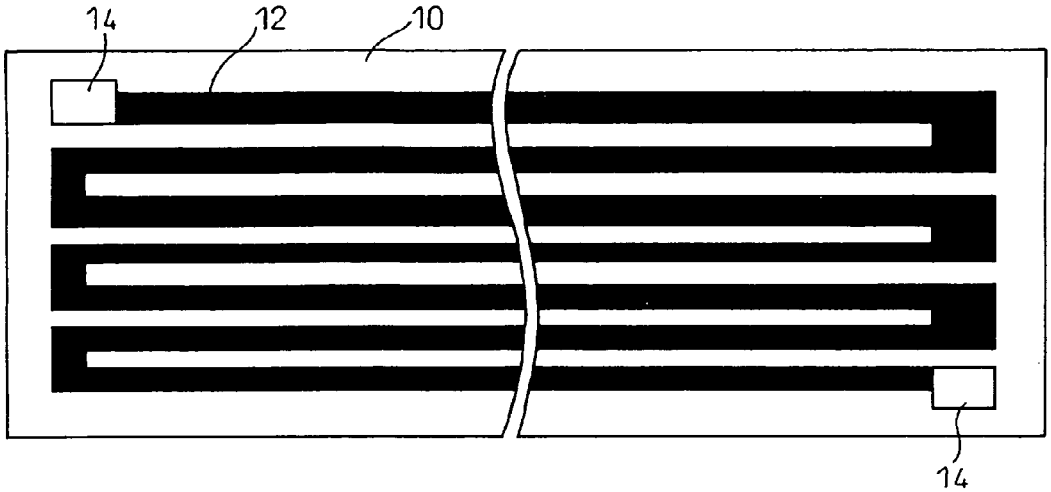
FIG. 3 is a view showing a third example of the pattern of heating element layer.
Figure 4:
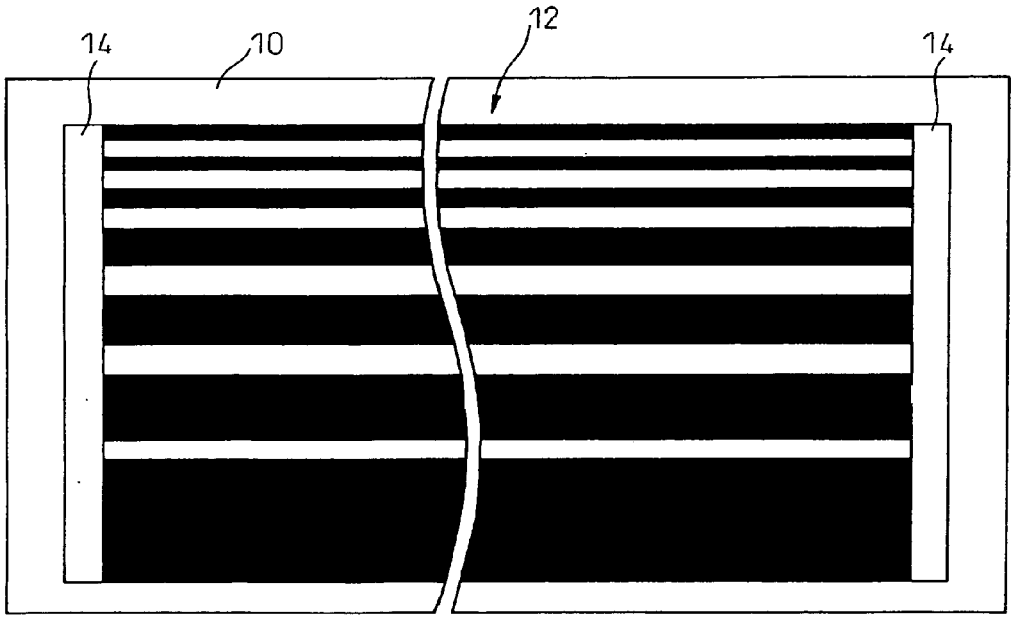
FIG. 4 is a view showing a fourth example of the pattern of heating element layer.
Figure 5:
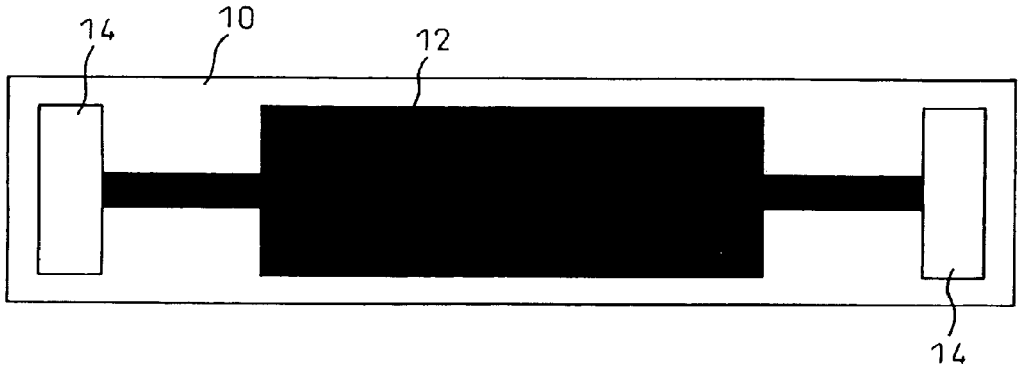
FIG. 5 is a view showing a fifth example of the pattern of heating element layer.
Figure 6:
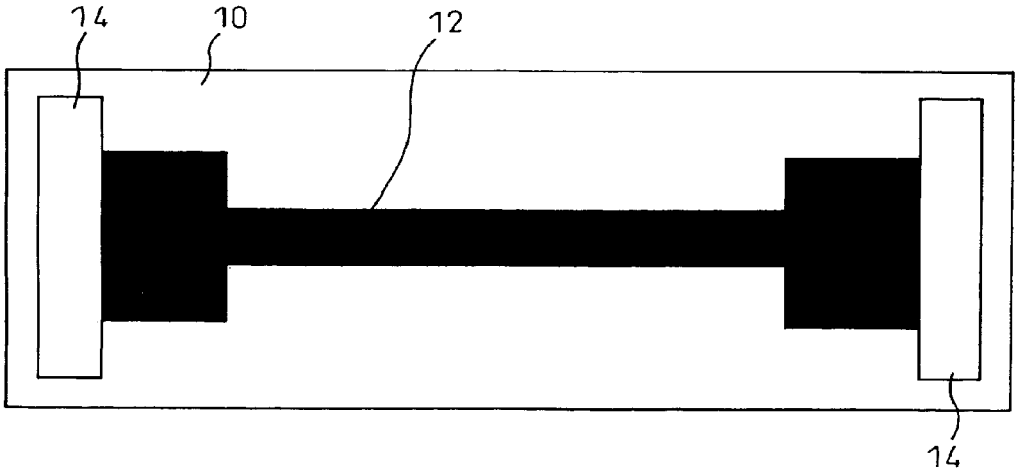
FIG. 6 is a view showing a sixth example of the pattern of heating element layer.

FIGS. 1 to 6 are views showing examples of the pattern of a heating element layer provided on a substrate in a fixing heater of the present invention. In the example shown in FIG. 1, the heating element 12 is provided in a straight line on the substrate 10 with an electrode layer 14 provided at each end. In the example shown in FIG. 2, the heating element 12 is formed in U-shape for one round trip on the substrate 10. FIG. 3 is a view showing an example of plural round trips on the substrate 10. FIG. 4 shows an example in which width and/or cross sectional area is varied in the direction perpendicular to the direction from one electrode to the other electrode in order to control the temperature distribution. FIGS. 5 and 6 are views showing examples in which width and/or cross sectional area is varied in the direction from one electrode to the other electrode.

Examples of above-mentioned metal or semi-metal compound include generally available metal carbides, metal borides, metal silicides, metal nitrides, metal oxides, semi-metal nitrides, semi-metal oxides, semi-metal carbides, etc. The type and amount of the metal or semi-metal compound species used are suitably selected in accordance with the resistance value and shape of the intended heating element. The metal or semi-metal compounds may be used alone or in a mixture of two or more compounds. It is preferable especially in view of simplicity of the resistance control to use boron carbide, silicon carbide, boron nitride, aluminium oxide, and in order to maintain the excellent characteristics of carbon, the amount used is preferably 70% or less.

Examples of the above-mentioned carbon-containing resin include, specifically, thermoplastic resins such as polyvinyl chloride, polyacrylonitorile, polyvinyl alcohol, polyvinyl chloride-polyvinyl acetate copolymer, plyamide, etc., heat curable resins such as phenol resins, furan resins, epoxy resins, unsaturated polyester resins, polyimides, etc., natural polymer materials having condensed polycyclic aromatic compound in the basic structure of the molecule, such as lignin, celluloses, tragacanth gum, gum arabic, sugars, etc., and synthetic polymer materials not included in above mentioned category having condensed polycyclic aromatic compound in the basic structure of the molecule, such as formalin condensate of naphthalene sulfonic acid, COPNA resin, etc. Polyvinyl chloride resins and furan resins are preferably used, and the amount used is preferably 30% or more.

Examples of the above-mentioned carbon powder include carbon black, graphite, coke powder, etc. In particular, graphite is preferably used.

Example 1

70 parts of furan resin (manufactured by Hitachi Chemical Co.) and 30 parts of boron nitride (manufactured by Shin-Etsu Chemical Co.) are mixed and dispersed thoroughly to obtain liquid material for preparing a flat plate. This liquid is applied onto an alumina substrate to form a green sheet on the substrate. This is subjected to a heat-curing process and to sintering at 1000° C. in an inactive atmosphere to obtain a carboneous heating element on the alumina substrate. The carboneous heating element obtained on the alumina substrate is a heating element 0.1 mm in thickness, 4 mm in width, 300 mm in length with NTC characteristics having a value of 4×10-3 Ω·cm at a low temperature.

Example 2

To 33 parts of chlorinated vinyl chloride resin (T-741, manufactured by Nippon Carbide Industries Co.), 1 part of natural graphite powder (manufactured by Nippon Graphite Industries Co., mean particle diameter 5 μm) and 67 parts of boron nitride (manufactured by Shin-Etsu Chemical Industries Co., mean particle diameter 2 μm) was added 20 parts of diallylphthalate monomer as plasticizer, and the mixture was dispersed using a Henschel mixer and was thoroughly and repeatedly kneaded using a double mixing roll with surface temperature maintained at 120° C. to obtain a composition. The composition was pelletized using a pelletizer to obtain a composition for molding. The pellet was molded by extrusion using a screw type extruder and was heat-treated for 5 hours in an air oven heated to 200° C. to obtain a precursor (carbon precursor) plate material, which was sintered in an inactive atmosphere at 1000° C. to obtain a plate-like carboneous heating element.

The carboneous heating element thus obtained was a heating element 0.3 mm in thickness, 6 mm in width and with NTC characteristics at a low temperature of 4×10-3 Ω·cm. The carboneous heating element obtained was cut into pieces of 300 mm in length and was mounted to an alumina substrate. Electrodes were provided at end portions for supplying electricity and glass insulating protective layer was provided on the surface of the heating element.

Example 3

The carbon precursor in Example 2 was sintered in vacuum at 2000° C. to obtain a plate-like carboneous heating element.

The carboneous heating element thus obtained was a heating element 0.3 mm in thickness, 3 mm in width and with PTC characteristics at a low temperature of 4×10-3 Ω·cm. The carboneous heating element obtained was cut into pieces of 300 mm in length and was mounted to an alumina substrate. Electrodes were provided at end portions for supplying electricity and a glass insulating protective layer was provided on the surface of the heating element.

Example 4

70 parts of furan resin (manufactured by Hitachi Chemical Co.) and 30 parts of natural graphite (as before) were thoroughly mixed and dispersed to obtain liquid material for preparing a flat plate. The liquid was applied to an alumina substrate by screen printing to prepare a green sheet on the substrate. The green sheet was subjected to heat curing processing, and then was sintered at 1000° C. in an inactive atmosphere to obtain a carboneous heating element on the alumina substrate. The carboneous heating element obtained on the alumina substrate was a heating element 0.06 mm in thickness, 3 mm in width and 300 mm in length and with NTC characteristics at low temperature of 2×10-3 Ω·cm. Electrodes were provided at both end portions and a glass insulating protective layer was provided on the surface of the heating element.

What is claimed is:

1. A fixing heater comprising:

a substrate; and a carboneous heating element layer provided on the substrate and consisting of amorphous carbon acting as an electrical conduction inhibiting material and carbon powder selected from the group consisting of carbon black, graphite and coke powder and uniformly dispersed in the amorphous carbon, and unavoidable impurities, wherein said carbon heating element layer has an intrinsic resistance value adjusted by adjusting a ratio of the amorphous carbon to the carbon powder.

2. A fixing heater as claimed in claim 1, wherein said carboneous heating element layer has a negative temperature coefficient.

* * * * *